US011300329B2

(12) United States Patent
Yan et al.

(10) Patent No.: US 11,300,329 B2
(45) Date of Patent: Apr. 12, 2022

(54) TWO-PIPE ENHANCED-VAPOR-INJECTION OUTDOOR UNIT AND MULTI-SPLIT SYSTEM

(71) Applicants: HEFEI MIDEA HEATING & VENTILATING EQUIPMENT CO., LTD., Hefei (CN); GD MIDEA HEATING & VENTILATING EQUIPMENT CO., LTD., Foshan (CN)

(72) Inventors: Libo Yan, Hefei (CN); Guozhong Yang, Hefei (CN); Mingren Wang, Hefei (CN); Sanguo Peng, Hefei (CN); Jinyuan Huang, Hefei (CN)

(73) Assignees: HEFEI MIDEA HEATING & VENTILATING EQUIPMENT CO., LTD., Hefei (CN); GD MIDEA HEATING & VENTILATING EQUIPMENT CO., LTD., Foshan (CN)

( * ) Notice: Subject to any disclaimer, the term of this patent is extended or adjusted under 35 U.S.C. 154(b) by 192 days.

(21) Appl. No.: 16/619,729

(22) PCT Filed: Jun. 3, 2019

(86) PCT No.: PCT/CN2019/089869
§ 371 (c)(1),
(2) Date: Dec. 5, 2019

(87) PCT Pub. No.: WO2020/082741
PCT Pub. Date: Apr. 30, 2020

(65) Prior Publication Data

US 2020/0158384 A1 May 21, 2020

(30) Foreign Application Priority Data

Oct. 22, 2018 (CN) ..... 201811227771.9

(51) Int. Cl.
*F25B 13/00* (2006.01)
*F24F 1/32* (2011.01)
(Continued)

(52) U.S. Cl.
CPC ..... *F25B 13/00* (2013.01); *F24F 1/32* (2013.01); *F25B 41/20* (2021.01); *F25B 41/30* (2021.01);
(Continued)

(58) Field of Classification Search
CPC .. F25B 2313/0233; F25B 13/00; F25B 40/00; F25B 2313/006; F25B 2313/0231; F25B 2313/027
See application file for complete search history.

(56) References Cited

U.S. PATENT DOCUMENTS 10,612,799 B2 * 4/2020 Luo ..... F25B 41/31
2013/0019624 A1 * 1/2013 Tamaki ..... F25B 13/00 62/196.1
(Continued)

FOREIGN PATENT DOCUMENTS

CN 105008820 A 10/2015
CN 106352572 A 1/2017
(Continued)

OTHER PUBLICATIONS

International Search Report and Written Opinion dated Aug. 21, 2019 from State Intellectual Property Office of the P.R. China.
(Continued)

*Primary Examiner* — Ana M Vazquez
(74) *Attorney, Agent, or Firm* — Dilworth & Barrese, LLP.; Michael J. Musella, Esq.

(57) ABSTRACT

A two-pipe enhanced-vapor-injection outdoor unit and a multi-split system are provided. The two-pipe enhanced-vapor-injection outdoor unit includes: an outdoor heat
(Continued)

exchanger and a second port; an enhanced-vapor-injection compressor, including a gas discharge port, a gas return port and an injection port; a reversing assembly, including first to fourth ends; a supercooler, including a main heat-exchange flow path and an auxiliary heat-exchange flow path communicated with each other, the main heat-exchange flow path being connected to the second port, the auxiliary heat-exchange flow path being connected to the injection port; and a throttling assembly having a first end connected to an outlet of the main heat-exchange flow path, and a second end connected to an inlet of the outdoor heat exchanger.

17 Claims, 7 Drawing Sheets

(51) Int. Cl.
*F25B 41/20* (2021.01)
*F25B 41/30* (2021.01)

(52) U.S. Cl.
CPC ... *F25B 2313/005* (2013.01); *F25B 2313/027* (2013.01)

(56) References Cited

U.S. PATENT DOCUMENTS

2013/0061622 A1* 3/2013 Kubota ..... F25B 7/00 62/238.6
2015/0362235 A1 12/2015 Koji et al.

FOREIGN PATENT DOCUMENTS

| | | | |
|---|---|---|---|
| CN | 109386989 | A | 2/2019 |
| EP | 2808626 | A1 | 12/2014 |
| JP | 2015059719 | A | 3/2015 |
| JP | 2016125721 | A | 7/2016 |
| JP | 6311249 | B2 | 4/2018 |

OTHER PUBLICATIONS

Search Report dated Nov. 28, 2019 from State Intellectual Property Office of the P.R. China.
First Chinese Office Action dated Dec. 6, 2019.
Canadian Office Action from Canadian Application No. 3081380 dated Jun. 8, 2021.

* cited by examiner

TWO-PIPE ENHANCED-VAPOR-INJECTION OUTDOOR UNIT AND MULTI-SPLIT SYSTEM

CROSS-REFERENCE TO RELATED APPLICATION

The present disclosure is a U.S. national stage filing of PCT/CN2019/089869 filed Jun. 3, 2019, and is based on and claims priority to Chinese Patent Application No. 201811227771.9, filed on Oct. 22, 2018, the entire content of which are incorporated herein by reference.

FIELD

The present disclosure relates to a technical field of air conditioners, and particularly to a two-pipe enhanced-vapor-injection outdoor unit and a two-pipe enhanced-vapor-injection multi-split system.

BACKGROUND

Currently, the conventional enhanced vapor injection and low-temperature forced heat change technologies are only used in the heat pump and the three-pipe heat recovery system. Since the gas return pipe of the outdoor unit in the two-pipe system just has the low pressure, it is difficult to achieve the enhanced vapor injection at the injection port of the compressor. Thus, the two-pipe multi-split system has the low pressure at the low-pressure side, the low density of the returned gas, and the small refrigerant circulation, and hence has the problem of insufficient heating capacity in the low-temperature environment, due to the low environment temperature. Moreover, the two-pipe system has problems of the high exhaust superheat degree and the insufficient heating capacity in the high-pressure environment.

SUMMARY

The present disclosure intends to at least solve one of the technical problems existing in the related art.

An aspect of the present disclosure provides a two-pipe enhanced-vapor-injection outdoor unit.

Another aspect of the present disclosure provides a two-pipe enhanced-vapor-injection multi-split system.

In view of the above, the present disclosure provides a two-pipe enhanced-vapor-injection outdoor unit. The two-pipe enhanced-vapor-injection outdoor unit includes: an outdoor heat exchanger and a second port; an enhanced-vapor-injection compressor having a gas discharge port, a gas return port and an injection port; a reversing assembly including first to fourth ends, the first end of the reversing assembly being connected with the gas discharge port, the second end of the reversing assembly being connected with the gas return port; a supercooler including a main heat-exchange flow path and an auxiliary heat-exchange flow path communicated with each other, the main heat-exchange flow path being connected with the second port, and the auxiliary heat-exchange flow path being connected with the injection port; and a throttling assembly including a first end connected with an outlet of the main heat-exchange flow path, and a second end connected with an inlet of the outdoor heat exchanger.

The two-pipe enhanced-vapor-injection outdoor unit provided by the present disclosure includes the outdoor heat exchanger, the enhanced-vapor-injection compressor, the reversing assembly, the supercooler, and the throttling assembly. The first end of the reversing assembly is connected with the gas discharge port, and the second end of the reversing assembly is connected with the gas return port. The main heat-exchange flow path of the supercooler is communicated with the auxiliary heat-exchange flow path of the supercooler. The main heat-exchange flow path is connected with the second port. The auxiliary heat-exchange flow path is connected with the injection port. The first end of the throttling assembly is connected with the outlet of the main heat-exchange flow path, and the second end of the throttling assembly is connected with the inlet of the outdoor heat exchanger. In the present disclosure, by using the enhanced-vapor-injection compressor, the gaseous refrigerant flowing out of the enhanced-vapor-injection heat exchanger directly enters the compressor through the middle injection port for the enhanced-vapor-injection compression. Moreover, the supercooler and the throttling assembly are added to significantly increase a refrigerant circulation in a heating operation at a low temperature, such that a range of the heating operation at the low temperature is expanded in the two-pipe enhanced-vapor-injection outdoor unit, and also the heating capacity is improved significantly.

The two-pipe enhanced-vapor-injection outdoor unit is a two-pipe structure, and two connection pipes are provided between an indoor unit and the outdoor unit. That is, the first port and the second port are connected with the indoor unit. Compared with the three-pipe multi-split system in the related art, the two-pipe heat-recovery multi-split system provided by the present disclosure has a simple structure, such that the cupper materials are saved, and the mounting cost is reduced.

In addition, the two-pipe enhanced-vapor-injection outdoor unit provided by the present disclosure is used in the two-pipe enhanced-vapor-injection multi-split system, and the multi-split system is a heat-recovery multi-split system. The heat recovery means that the heat discharged from the cooling room is recovered for heating of the heating room. Specifically, the system uses the indoor-unit heat exchanger to absorb heat from the cooling room, then the indoor-unit heat exchanger releases such heat completely or partially to the heating room for heating, and the heat lacked by the system or the remaining heat of the system is obtained from the environment by the outdoor-unit heat exchanger. However, for the ordinary heat-pump multi-split system, the heat required by the heating indoor unit totally comes from the heat absorption and the power consumption of the outdoor-unit heat exchanger. Thus, compared with the ordinary heat pump, the heat-recovery multi-split system has a significant energy-saving effect.

The heat-recovery multi-split system includes four operation modes, namely a cooling mode, a main cooling mode, a main heating mode and a heating mode. When all the operating indoor units are in the cooling mode/the heating mode, the outdoor unit operates in the cooling mode/the heating mode. When a part of the operating indoor units are in the cooling mode, another part of the operating indoor units are in the heating mode, and the cooling load is greater than the heating load, the outdoor unit will operate in the main cooling mode. When a part of the operating indoor units are in the cooling mode, another part of the operating indoor units are in the heating mode, and the cooling load is less than the heating load, the outdoor unit will operate in the main heating mode. If the flow rate required for running the cooling indoor units is exactly equal to the flow rate required for running the heating indoor units, the system operates in a full heat-recovery mode.

In addition, the two-pipe enhanced-vapor-injection outdoor unit according to the above technical solutions of the present disclosure further includes following additional technical features.

In any of the above technical solutions, in some embodiments of the present disclosure, the third end of the reversing assembly is switchably connected to the inlet of the outdoor heat exchanger or the outlet of the outdoor heat exchanger, and the fourth end of the reversing assembly is switchably connected to the second port or the first port.

In this technical solution, the third end of the reversing assembly is switchably connected to the inlet of the outdoor heat exchanger or the outlet of the outdoor heat exchanger, and the fourth end of the reversing assembly is switchably connected to the second port or the first port. When the two-pipe enhanced-vapor-injection multi-split system is in the cooling mode and the main cooling mode, the third end of the reversing assembly is connected to the inlet of the outdoor heat exchanger, and the fourth end of the reversing assembly is connected to the second port. When the two-pipe enhanced-vapor-injection multi-split system is in the heating mode and the main heating mode, the third end of the reversing assembly is connected to the outlet of the outdoor heat exchanger, and the fourth end of the reversing assembly is connected to the first port, so as to achieve different flow directions of the refrigerant.

In any of the above technical solutions, in some embodiments of the present disclosure, an inlet of the main heat-exchange flow path is connected with the second port, an inlet of the auxiliary heat-exchange flow path is connected with the outlet of the main heat-exchange flow path, and an outlet of the auxiliary heat-exchange flow path is connected with the injection port.

In this technical solution, a specific connection manner inside the supercooler is provided, that is, the inlet of the main heat-exchange flow path is connected to the second port, the inlet of the auxiliary heat-exchange flow path is connected to the outlet of the main heat-exchange flow path, and the outlet of the auxiliary heat-exchange flow path is connected to the injection port. In the heating mode or the main heating mode, the refrigerant flowing in through the second port first enters the inlet of the main heat-exchange flow path, then enters the inlet of the auxiliary heat-exchange flow path from the outlet of the main heat-exchange flow path, and further enters the injection port from the outlet of the auxiliary heat-exchange flow path, so as to achieve the enhanced-vapor-injection compression of the enhanced-vapor-injection compressor.

In any of the above technical solutions, in some embodiments of the present disclosure, the inlet of the main heat-exchange flow path and the inlet of the auxiliary heat-exchange flow path are both connected to the second port, and the outlet of the auxiliary heat-exchange flow path is connected to the injection port.

In this technical solution, a specific connection manner inside the supercooler is provided, that is, the inlet of the main heat-exchange flow path and the inlet of the auxiliary heat-exchange flow path are both connected to the second port, and the outlet of the auxiliary heat-exchange flow path is connected to the injection port. In the heating mode or the main heating mode, the refrigerant flowing in through the second port enters the inlet of the main heat-exchange flow path and the inlet of the auxiliary heat-exchange flow path, respectively, and then passes through the main heat-exchange flow path and the auxiliary heat-exchange flow path, respectively; the refrigerant flowing out of the main heat-exchange flow path passes through the throttling assembly and enters the inlet of the outdoor heat exchanger; the refrigerant flowing out of the auxiliary heat-exchange flow path enters the enhanced-vapor-injection compressor through the injection port, so as to achieve the enhanced-vapor-injection compression of the enhanced-vapor-injection compressor.

In any of the above technical solutions, in some embodiments of the present disclosure, the two-pipe enhanced-vapor-injection outdoor unit includes a first solenoid valve disposed between the auxiliary heat-exchange flow path and the injection port, and the first solenoid valve has a conduction direction from the auxiliary heat-exchange flow path to the injection port.

In this technical solution, the two-pipe enhanced-vapor-injection outdoor unit includes the first solenoid valve, and the first solenoid valve is conducted when powered on, and closed when powered off. When the first solenoid valve is powered on to be conducted, the conduction direction of the first solenoid valve is from the auxiliary heat-exchange flow path to the injection port, i.e. a conduction direction, in which the refrigerant is only allowed to flow from the auxiliary heat-exchange flow path to the injection port, so as to avoid the refrigerant backflow phenomenon.

In any of the above technical solutions, in some embodiments of the present disclosure, the two-pipe enhanced-vapor-injection outdoor unit includes a first throttling device. The first throttling device is arranged in the auxiliary heat-exchange flow path, and located at an inlet of the auxiliary heat-exchange flow path.

In this technical solution, the two-pipe enhanced-vapor-injection outdoor unit includes the first throttling device. The first throttling device is arranged in the auxiliary heat-exchange flow path, and located at the inlet of the auxiliary heat-exchange flow path. Thus, after the refrigerant passes through the main heat-exchange flow path, a part of the refrigerant is throttled and depressurized by the throttling device and further enters the auxiliary heat-exchange flow path. Then, the refrigerant in the auxiliary heat-exchange flow path exchanges heat with the refrigerant in the main heat-exchange flow path, so as to improve the heating capacity of the two-pipe enhanced-vapor-injection outdoor unit effectively, and enhance the reliability of the two-pipe enhanced-vapor-injection outdoor unit.

In any of the above technical solutions, in some embodiments of the present disclosure, the two-pipe enhanced-vapor-injection outdoor unit includes a first check valve and a second check valve. The first check valve connects the second port with a fourth end of the reversing assembly, and the first check valve has a conduction direction from the second port to the fourth end of the reversing assembly. The second check valve connects the first port with the fourth end of the reversing assembly, and the second check valve has a conduction direction from the fourth end of the reversing assembly to the first port.

In this technical solution, the two-pipe enhanced-vapor-injection outdoor unit includes the first check valve and the second check valve. The first check valve connects the second port with the fourth end of the reversing assembly, and the conduction direction of the first check valve is from the second port to the fourth end of the reversing assembly. The second check valve connects the first port to the fourth end of the reversing assembly, and the conduction direction of the second check valve is from the fourth end of the reversing assembly to the first port. During operations in the cooling mode and the main cooling mode, the first check valve is conducted, and the second check valve is closed.

During operations in the heating mode and the main heating mode, the second check valve is conducted, and the first check valve is closed.

In any of the above technical solutions, in some embodiments of the present disclosure, the two-pipe enhanced-vapor-injection outdoor unit includes a third check valve and a fourth check valve. The third check valve connects the third end of the reversing assembly to the inlet of the outdoor heat exchanger, and has a conduction direction from the third end of the reversing assembly to the outdoor heat exchanger. The fourth check valve connects the third end of the reversing assembly to the outlet of the outdoor heat exchanger, and has a conduction direction from the outlet of the outdoor heat exchanger to the third end of the reversing assembly.

In this technical solution, the two-pipe enhanced-vapor-injection outdoor unit includes the third check valve and the fourth check valve. The third check valve and the fourth check valve are both connected with the third end of the reversing assembly, and the other ends of the third check valve and the fourth check valve are connected to the inlet of the outdoor heat exchanger and the outlet of the outdoor heat exchanger, respectively. The third check valve has the conduction direction from the third end of the reversing assembly to the outdoor heat exchanger. The fourth check valve has the conduction direction from the outlet of the outdoor heat exchanger to the third end of the reversing assembly. During operations in the cooling mode and the main cooling mode, the third check valve is conducted, and the fourth check valve is closed. During operations in the heating mode and the main heating mode, the fourth check valve is conducted, and the third check valve is closed.

In any of the above technical solutions, in some embodiments of the present disclosure, the throttling assembly includes at least one second throttling device and at least one fifth check valve connected in series. The fifth check valve has a conduction direction from the supercooler to the inlet of the outdoor heat exchanger.

In this technical solution, the throttling assembly includes the at least one second throttling device and the at least one fifth check valve connected in series. The conduction direction of the fifth check valve is from the supercooler to the inlet of the outdoor heat exchanger. One second throttling device may be connected in series with one fifth check valve, or one second throttling device may be connected in series with a plurality of fifth check valves, or a plurality of second throttling devices may be connected in series with one fifth check valve, so as to ensure the effects of throttling and depressurization, and thus a better depressurization effect can be achieved after multi-stage depressurizations.

In any of the above technical solutions, in some embodiments of the present disclosure, the two-pipe enhanced-vapor-injection outdoor unit includes a second pipe connecting the gas discharge port to the first port, and a second solenoid valve disposed in the second pipe, and having a conduction direction from the gas discharge port to the first port.

In this technical solution, the two-pipe enhanced-vapor-injection outdoor unit includes the second pipe and the second solenoid valve disposed in the second pipe. During the operation in the cooling mode, the second solenoid valve is closed, all the refrigerant discharged out of the gas discharge port enters the inlet of the outdoor heat exchanger through the third end of the reversing assembly. During the operation in the main cooling mode, the second solenoid valve is turned on, a part of the refrigerant discharged out of the gas discharge port enters the inlet of the outdoor heat exchanger through the third end of the reversing assembly, and another part of the refrigerant discharged out of the gas discharge port enters the first port through the second solenoid valve, so as to ensure that the two-pipe enhanced-vapor-injection multi-split system can realize the cooling mode and the main cooling mode.

In any of the above technical solutions, in some embodiments of the present disclosure, the two-pipe enhanced-vapor-injection outdoor unit includes a third pipe and a sixth check valve. The third pipe has a first end connected with the outlet of the outdoor heat exchanger, and a second end arranged between the second check valve and the first port. The sixth check valve is arranged in the third pipe.

In this technical solution, the two-pipe enhanced-vapor-injection outdoor unit includes the third pipe and the sixth check valve. In the heating mode and the main heating mode, the sixth check valve is turned on, and the refrigerant discharged out of the outlet of the outdoor heat exchanger passes through the sixth check valve into the first port. In the cooling mode and the main cooling mode, the sixth check valve is closed.

In any of the above technical solutions, in some embodiments of the present disclosure, the two-pipe enhanced-vapor-injection outdoor unit includes a seventh check valve. The seventh check valve connects the main heat-exchange flow path with the second port, and has a conduction direction from the second port to the inlet of the main heat-exchange flow path.

In this technical solution, the two-pipe enhanced-vapor-injection outdoor unit includes the seventh check valve, and the conduction direction of the seventh check valve is from the second port to the inlet of the main heat-exchange flow path. In the heating mode and the main heating mode, the seventh check valve is turned on. In the cooling mode and the main cooling mode, the seventh check valve is closed. Thus, in the heating mode and the main heating mode, the enhanced-vapor-injection compressor can achieve the effect of enhanced vapor injection, and in the cooling mode and the main cooling mode, the refrigerant cannot pass through the supercooler, and thus the effect of enhanced vapor injection cannot be achieved.

According to an aspect of the present disclosure, a two-pipe enhanced-vapor-injection multi-split system is provided. The two-pipe enhanced-vapor-injection multi-split system includes the two-pipe enhanced-vapor-injection outdoor unit according to any of the above technical solutions. Therefore, the two-pipe enhanced-vapor-injection multi-split system has all the significant effects of the two-pipe enhanced-vapor-injection outdoor unit according to any of the above technical solutions.

Additional aspects and advantages of embodiments of present disclosure will be given in the following descriptions, become apparent in part from the following descriptions, or be learned from the practice of the embodiments of the present disclosure.

BRIEF DESCRIPTION OF THE DRAWINGS

The above and/or additional aspects and advantages of the present disclosure will become apparent and more readily appreciated from the following descriptions made with reference to the drawings, in which.

REFERENCE NUMERALS

Figure 1:
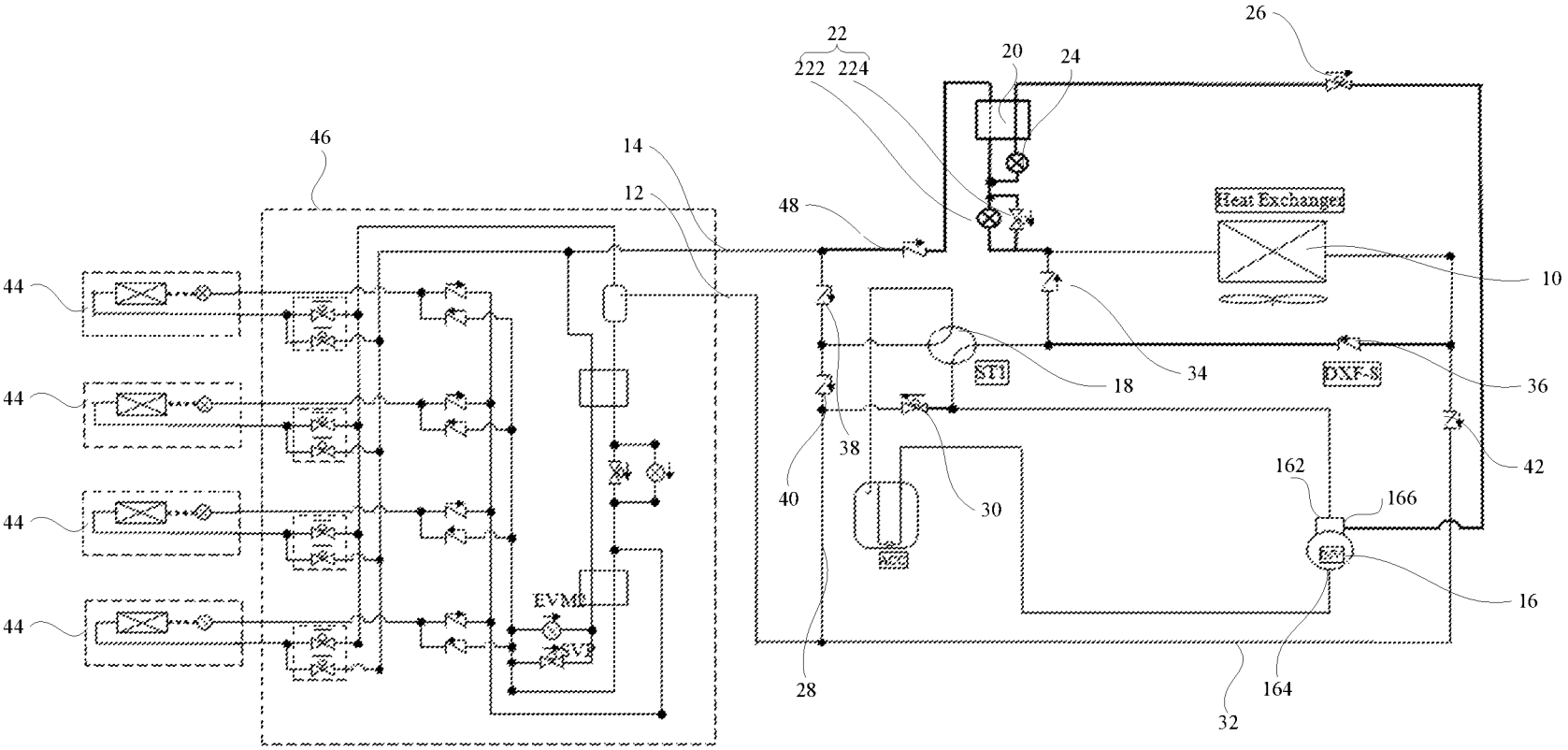
FIG. 1 illustrates a schematic view of a two-pipe enhanced-vapor-injection multi-split system provided by an embodiment of the present disclosure.
Figure 2:
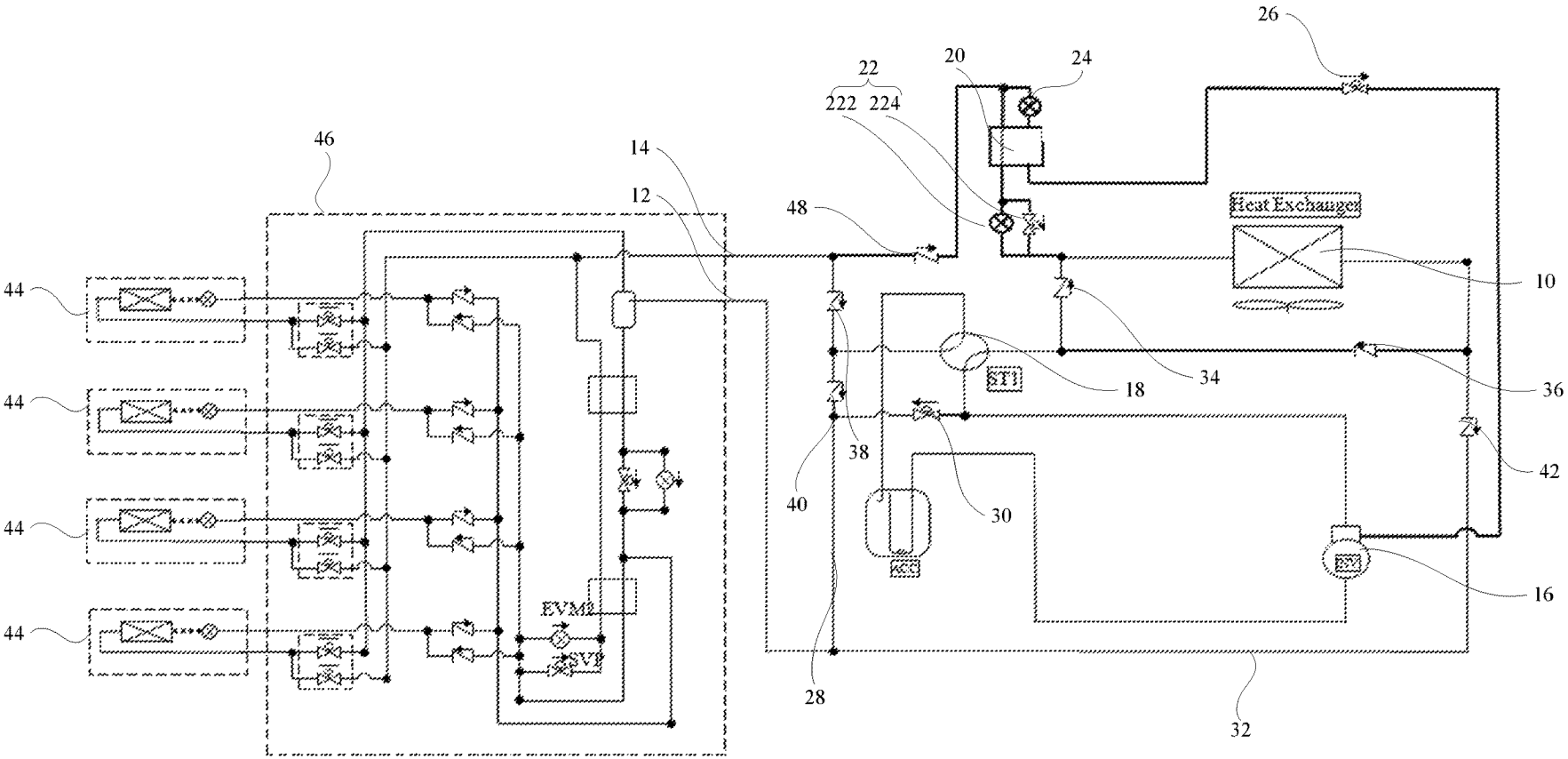
FIG. 2 illustrates another schematic view of a two-pipe enhanced-vapor-injection multi-split system provided by an embodiment of the present disclosure.

Reference numerals in FIG. 1 to FIG. 6 have following corresponding relationships with names of parts.

10 outdoor heat exchanger, 12 first port, 14 second port, 16 enhanced-vapor-injection compressor, 162 gas discharge port, 164 gas return port, 166 injection port, 18 reversing assembly, 20 supercooler, 22 throttling assembly, 222 second throttling device, 224 fifth check valve, 24 first throttling device, 26 first solenoid valve, 28 second pipe, 30 second solenoid valve, 32 third pipe, 34 third check valve, 36 fourth check valve, 38 first check valve, 40 second check valve, 42 sixth solenoid valve, 44 two-pipe enhanced-vapor-injection indoor unit, 46 refrigerant-flow-direction switching device, 48 seventh check valve.

DETAILED DESCRIPTION

In order to clearly understand the above objectives, features and advantages of the present disclosure, the present disclosure is further described in detail with reference to the accompanying drawings and specific embodiments. It is to be noted that, in the case of no conflict, the embodiments of the present disclosure and the features in the embodiments can be combined with each other.

In the following descriptions, many specific details are set forth so as to provide a thorough understanding of the present disclosure. However, the present disclosure may be implemented in other manners other than what are described herein. The scope protection of the present disclosure is not limited by the specific embodiments disclosed below.

A two-pipe enhanced-vapor-injection outdoor unit and system according to an embodiment of the present disclosure will be described with reference to FIGS. 1 to 7.

As illustrated in FIGS. 1 to 6, the two-pipe enhanced-vapor-injection outdoor unit provided by the present disclosure includes: an outdoor heat exchanger 10, a first port 12 and a second port 14; an enhanced-vapor-injection compressor 16 having an gas discharge port 162, an gas return port 164 and an injection port 166; a reversing assembly 18, including first to fourth ends, the first end of the reversing assembly 18 being connected with the gas discharge port 162, and the second end of the reversing assembly 18 being connected with the gas return port 164; a supercooler 20, including a main heat-exchange flow path and an auxiliary heat-exchange flow path communicated with each other, the main heat-exchange flow path being connected with the second port 14, the auxiliary heat-exchange flow path being connected with the injection port 166; and a throttling assembly 22 having a first end connected with an outlet of the main heat-exchange flow path, and a second end connected with an inlet of the outdoor heat exchanger 10.

The two-pipe enhanced-vapor-injection outdoor unit provided by the present disclosure includes the outdoor heat exchanger 10, the enhanced-vapor-injection compressor 16, the reversing assembly 18, the supercooler 20, and the throttling assembly 22. The first end of the reversing assembly 18 is connected with the gas discharge port 162, and the second end of the reversing assembly 18 is connected with the gas return port 164. The main heat-exchange flow path of the supercooler 20 is communicated with the auxiliary heat-exchange flow path of the supercooler 20. The main heat-exchange flow path is connected with the second port 14. The auxiliary heat-exchange flow path is connected with the injection port 166. The first end of the throttling assembly 22 is connected with the outlet of the main heat-exchange flow path, and the second end of the throttling assembly 22 is connected with the inlet of the outdoor heat exchanger 10. In the present disclosure, by using the enhanced-vapor-injection compressor 16, the gaseous refrigerant flowing out of the enhanced-vapor-injection heat exchanger directly enters the compressor through the middle injection port 166 for the enhanced-vapor-injection compression. Moreover, the supercooler 20 and the throttling assembly 22 are added to significantly increase a refrigerant circulation in a heating operation at a low temperature, such that a range of the heating operation at the low temperature is expanded in the two-pipe enhanced-vapor-injection outdoor unit, and also the heating capacity is improved significantly.

The two-pipe enhanced-vapor-injection outdoor unit is a two-pipe structure, and two connection pipes are provided between an indoor unit and the outdoor unit. That is, the first port 12 and the second port 14 are connected with the indoor unit. Compared with the three-pipe multi-split system in the related art, the two-pipe heat-recovery multi-split system provided by the present disclosure has a simple structure, such that the cupper materials are saved, and the mounting cost is reduced.

In addition, the two-pipe enhanced-vapor-injection outdoor unit provided by the present disclosure is used in the two-pipe enhanced-vapor-injection multi-split system, and the multi-split system is a heat-recovery multi-split system. The heat recovery means that the heat discharged from the cooling room is recovered for heating of the heating room. Specifically, the system uses the indoor-unit heat exchanger to absorb heat from the cooling room, then the indoor-unit heat exchanger releases such heat completely or partially to the heating room for heating, and the heat lacked by the system or the remaining heat of the system is obtained from the environment by the outdoor-unit heat exchanger. However, for the ordinary heat-pump multi-split system, the heat required by the heating indoor unit totally comes from the heat absorption and the power consumption of the outdoor-unit heat exchanger. Thus, compared with the ordinary heat pump, the heat-recovery multi-split system has a significant energy-saving effect.

The heat-recovery multi-split system includes four operation modes, namely a cooling mode, a main cooling mode, a main heating mode and a heating mode. When all the operating indoor units are in the cooling mode/the heating mode, the outdoor unit operates in the cooling mode/the heating mode. When a part of the operating indoor units are in the cooling mode, another part of the operating indoor units are in the heating mode, and the cooling load is greater than the heating load, the outdoor unit will operate in the main cooling mode. When a part of the operating indoor units are in the cooling mode, another part of the operating indoor units are in the heating mode, and the cooling load is less than the heating load, the outdoor unit will operate in the main heating mode. If the flow rate required for running the cooling indoor units is exactly equal to the flow rate required for running the heating indoor units, the system operates in a full heat-recovery mode.

In an embodiment provided by the present disclosure, in some embodiments of the present disclosure, the third end of the reversing assembly 18 is switchably connected to the inlet of the outdoor heat exchanger 10 or the outlet of the outdoor heat exchanger 10, and the fourth end of the reversing assembly 18 is switchably connected to the second port 14 or the first port 12.

In this embodiment, the third end of the reversing assembly 18 is switchably connected to the inlet of the outdoor heat exchanger 10 or the outlet of the outdoor heat exchanger 10, and the fourth end of the reversing assembly 18 is switchably connected to the second port 14 or the first port 12. When the two-pipe enhanced-vapor-injection multi-split system is in the cooling mode and the main cooling mode, the third end of the reversing assembly 18 is connected to the inlet of the outdoor heat exchanger 10, and the fourth end of the reversing assembly 18 is connected to the second port 14. When the two-pipe enhanced-vapor-injection multi-split system is in the heating mode and the main heating mode, the third end of the reversing assembly 18 is connected to the outlet of the outdoor heat exchanger 10, and the fourth end of the reversing assembly 18 is connected to the first port 12, so as to achieve different flow directions of the refrigerant.

In an embodiment provided by the present disclosure, in some embodiments of the present disclosure, the inlet of the main heat-exchange flow path is connected to the second port 14, the inlet of the auxiliary heat-exchange flow path is connected to the outlet of the main heat-exchange flow path, and the outlet of the auxiliary heat-exchange flow path is connected to the injection port 166.

In this embodiment, a specific connection manner inside the supercooler 20 is provided, that is, the inlet of the main heat-exchange flow path is connected to the second port 14, the inlet of the auxiliary heat-exchange flow path is connected to the outlet of the main heat-exchange flow path, and the outlet of the auxiliary heat-exchange flow path is connected to the injection port 166. In the heating mode or the main heating mode, the refrigerant flowing in through the second port 14 first enters the inlet of the main heat-exchange flow path, then enters the inlet of the auxiliary heat-exchange flow path from the outlet of the main heat-exchange flow path, and further enters the injection port 166 from the outlet of the auxiliary heat-exchange flow path, so as to achieve the enhanced-vapor-injection compression of the enhanced-vapor-injection compressor 16.

In an embodiment provided by the present disclosure, in some embodiments of the present disclosure, the inlet of the main heat-exchange flow path and the inlet of the auxiliary heat-exchange flow path are both connected to the second port 14, and the outlet of the auxiliary heat-exchange flow path is connected to the injection port 166.

In this embodiment, a specific connection manner inside the supercooler 20 is provided, that is, the inlet of the main heat-exchange flow path and the inlet of the auxiliary heat-exchange flow path are both connected to the second port 14, and the outlet of the auxiliary heat-exchange flow path is connected to the injection port 166. In the heating mode or the main heating mode, the refrigerant flowing in through the second port 14 enters the inlet of the main heat-exchange flow path and the inlet of the auxiliary heat-exchange flow path, respectively, and then passes through the main heat-exchange flow path and the auxiliary heat-exchange flow path, respectively; the refrigerant flowing out of the main heat-exchange flow path passes through the throttling assembly 22 and enters the inlet of the outdoor heat exchanger 10; the refrigerant flowing out of the auxiliary heat-exchange flow path enters the enhanced-vapor-injection compressor through the injection port 166, so as to achieve the enhanced-vapor-injection compression of the enhanced-vapor-injection compressor 16.

In an embodiment provided by the present disclosure, in some embodiments of the present disclosure, the two-pipe enhanced-vapor-injection outdoor unit includes a first solenoid valve 26 disposed between the auxiliary heat-exchange flow path and the injection port 166, and the first solenoid valve 26 has a conduction direction from the auxiliary heat-exchange flow path to the injection port 166.

In this embodiment, the two-pipe enhanced-vapor-injection outdoor unit includes the first solenoid valve 26, and the first solenoid valve 26 is conducted when powered on, and closed when powered off. When the first solenoid valve 26 is powered on to be conducted, the conduction direction of the first solenoid valve 26 is from the auxiliary heat-exchange flow path to the injection port 166, i.e. a conduction direction, in which the refrigerant is only allowed to flow from the auxiliary heat-exchange flow path to the injection port 166, so as to avoid the refrigerant backflow phenomenon.

In an embodiment provided by the present disclosure, in some embodiments of the present disclosure, the two-pipe enhanced-vapor-injection outdoor unit includes a first throttling device 24. The first throttling device 24 is arranged in the auxiliary heat-exchange flow path, and located at the inlet of the auxiliary heat-exchange flow path.

In this embodiment, the two-pipe enhanced-vapor-injection outdoor unit includes the first throttling device 24. The first throttling device 24 is arranged in the auxiliary heat-exchange flow path, and located at the inlet of the auxiliary heat-exchange flow path. Thus, after the refrigerant passes through the main heat-exchange flow path, a part of the refrigerant is throttled and depressurized by the throttling device and further enters the auxiliary heat-exchange flow path. Then, the refrigerant in the auxiliary heat-exchange flow path exchanges heat with the refrigerant in the main heat-exchange flow path, so as to improve the heating capacity of the two-pipe enhanced-vapor-injection outdoor unit effectively, and enhance the reliability of the two-pipe enhanced-vapor-injection outdoor unit.

In an embodiment provided by the present disclosure, in some embodiments of the present disclosure, the two-pipe enhanced-vapor-injection outdoor unit includes a first check valve 38 and a second check valve 40. The first check valve 38 connects the second port 14 with the fourth end of the reversing assembly 18, and the first check valve 38 has a conduction direction from the second port 14 to the fourth end of the reversing assembly 18. The second check valve 40 connects the first port 12 with the fourth end of the reversing assembly 18, and the second check valve 40 has a conduction direction from the fourth end of the reversing assembly 18 to the first port 12.

In this embodiment, the two-pipe enhanced-vapor-injection outdoor unit includes the first check valve 38 and the second check valve 40. The first check valve 38 connects the second port 14 with the fourth end of the reversing assembly 18, and the conduction direction of the first check valve 38 is from the second port 14 to the fourth end of the reversing assembly 18. The second check valve 40 connects the first port 12 to the fourth end of the reversing assembly 18, and the conduction direction of the second check valve 40 is from the fourth end of the reversing assembly 18 to the first port 12. During operations in the cooling mode and the main cooling mode, the first check valve 38 is conducted, and the second check valve 40 is closed. During operations in the heating mode and the main heating mode, the second check valve 40 is conducted, and the first check valve 38 is closed.

In an embodiment provided by the present disclosure, in some embodiments of the present disclosure, the two-pipe enhanced-vapor-injection outdoor unit includes a third check valve 34 and a fourth check valve 36. The third check valve 34 connects the third end of the reversing assembly 18 to the inlet of the outdoor heat exchanger 10, and has a conduction direction from the third end of the reversing assembly 18 to the outdoor heat exchanger 10. The fourth check valve 36 connects the third end of the reversing assembly 18 to the outlet of the outdoor heat exchanger 10, and has a conduction direction from the outlet of the outdoor heat exchanger 10 to the third end of the reversing assembly 18.

In this embodiment, the two-pipe enhanced-vapor-injection outdoor unit includes the third check valve 34 and the fourth check valve 36. The third check valve 34 and the fourth check valve 36 are both connected with the third end of the reversing assembly 18, and the other ends of the third check valve 34 and the fourth check valve 36 are connected to the inlet of the outdoor heat exchanger 10 and the outlet of the outdoor heat exchanger 10, respectively. The third check valve 34 has the conduction direction from the third end of the reversing assembly 18 to the outdoor heat exchanger 10. The fourth check valve 36 has the conduction direction from the outlet of the outdoor heat exchanger 10 to the third end of the reversing assembly 18. During operations in the cooling mode and the main cooling mode, the third check valve 34 is conducted, and the fourth check valve 36 is closed. During operations in the heating mode and the main heating mode, the fourth check valve 36 is conducted, and the third check valve 34 is closed.

In an embodiment provided by the present disclosure, in some embodiments of the present disclosure, the throttling assembly 22 includes at least one second throttling device 222 and at least one fifth check valve 224 connected in series. The fifth check valve 224 has a conduction direction from the supercooler 20 to the inlet of the outdoor heat exchanger 10.

In this embodiment, the throttling assembly 22 includes the at least one second throttling device 222 and the at least one fifth check valve 224 connected in series. The conduction direction of the fifth check valve 224 is from the supercooler 20 to the inlet of the outdoor heat exchanger 10. One second throttling device 222 may be connected in series with one fifth check valve 224, or one second throttling device 222 may be connected in series with a plurality of fifth check valves 224, or a plurality of second throttling devices 222 may be connected in series with one fifth check valve 224, so as to ensure the effects of throttling and depressurization, and thus a better depressurization effect can be achieved after multi-stage depressurizations.

In an embodiment provided by the present disclosure, in some embodiments of the present disclosure, the two-pipe enhanced-vapor-injection outdoor unit includes a second pipe 28 connecting the gas discharge port 162 to the first port 12, and a second solenoid valve 30 disposed in the second pipe 28, and having a conduction direction from the gas discharge port 162 to the first port 12.

In this embodiment, the two-pipe enhanced-vapor-injection outdoor unit includes the second pipe 28 and the second solenoid valve 30 disposed in the second pipe 28. During the operation in the cooling mode, the second solenoid valve 30 is closed, all the refrigerant discharged out of the gas discharge port 162 enters the inlet of the outdoor heat exchanger 10 through the third end of the reversing assembly 18. During the operation in the main cooling mode, the second solenoid valve 30 is turned on, a part of the refrigerant discharged out of the gas discharge port 162 enters the inlet of the outdoor heat exchanger 10 through the third end of the reversing assembly 18, and another part of the refrigerant discharged out of the gas discharge port 162 enters the first port 12 through the second solenoid valve 30, so as to ensure that the two-pipe enhanced-vapor-injection multi-split system can realize the cooling mode and the main cooling mode.

In an embodiment provided by the present disclosure, in some embodiments of the present disclosure, the two-pipe enhanced-vapor-injection outdoor unit includes a third pipe 32 and a sixth check valve 42. The third pipe 32 has a first end connected with the outlet of the outdoor heat exchanger 10, and a second end arranged between the second check valve 40 and the first port 12. The sixth check valve 42 is arranged in the third pipe 32.

In this embodiment, the two-pipe enhanced-vapor-injection outdoor unit includes the third pipe 32 and the sixth check valve 42. In the heating mode and the main heating mode, the sixth check valve 42 is turned on, and the refrigerant discharged out of the outlet of the outdoor heat exchanger 10 passes through the sixth check valve 42 into the first port 12. In the cooling mode and the main cooling mode, the sixth check valve 42 is closed.

According to an aspect of the present disclosure, a two-pipe enhanced-vapor-injection multi-split system is provided. The two-pipe enhanced-vapor-injection multi-split system includes the two-pipe enhanced-vapor-injection outdoor unit according to any of the above embodiments. Therefore, the two-pipe enhanced-vapor-injection multi-split system has all the significant effects of the two-pipe enhanced-vapor-injection outdoor unit according to any of the above embodiments.

In an embodiment provided by the present disclosure, in some embodiments of the present disclosure, the two-pipe enhanced-vapor-injection outdoor unit includes a seventh check valve 48. The seventh check valve 48 connects the main heat-exchange flow path with the second port, and has a conduction direction from the second port to the inlet of the main heat-exchange flow path.

In this embodiment, the two-pipe enhanced-vapor-injection outdoor unit includes the seventh check valve 48, and the conduction direction of the seventh check valve 48 is from the second port to the inlet of the main heat-exchange flow path. In the heating mode and the main heating mode, the seventh check valve 48 is turned on. In the cooling mode and the main cooling mode, the seventh check valve 48 is closed. Thus, in the heating mode and the main heating mode, the enhanced-vapor-injection compressor can achieve the effect of enhanced vapor injection, and in the cooling mode and the main cooling mode, the refrigerant cannot pass through the supercooler, and thus the effect of enhanced vapor injection cannot be achieved.

The two-pipe enhanced-vapor-injection multi-split system includes a refrigerant-flow-direction switching device 46, and the refrigerant-flow-direction switching device 46 includes a gas-liquid separator for shunting of the gas-liquid two-phase refrigerant. A plate heat exchanger is used for obtaining a supercooling degree of a liquid refrigerant. Multiple groups of solenoid valves are used to switch the flow direction of the refrigerant.

Figure 3:
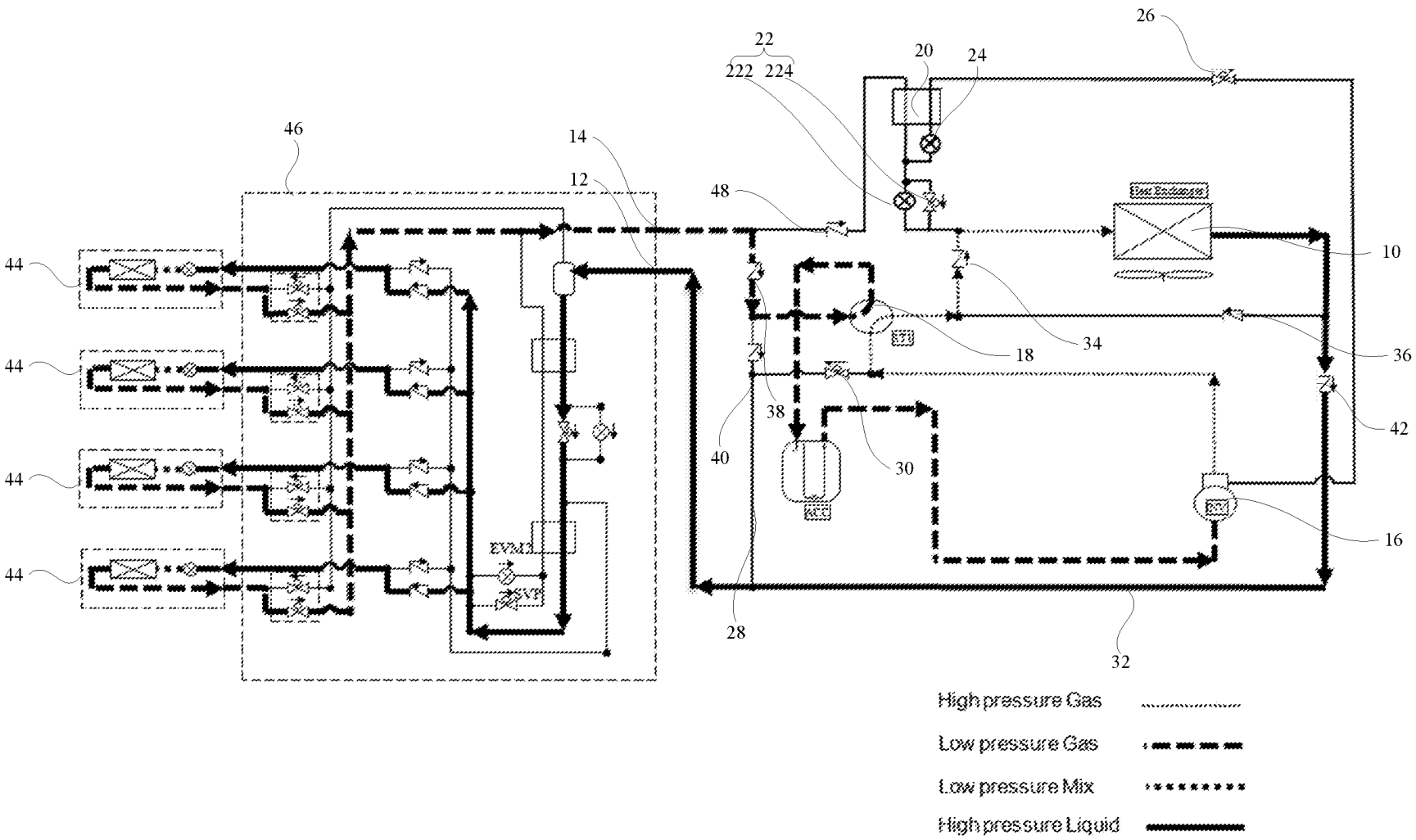
FIG. 3 illustrates a schematic view of a two-pipe enhanced-vapor-injection multi-split system in a cooling mode provided by an embodiment of the present disclosure.

As shown in FIG. 3, during heating, the high-temperature and high-pressure gaseous refrigerant comes out of the enhanced-vapor-injection compressor 16, passes through two paths, i.e. the second solenoid valve 30 as well as the reversing assembly 18 and the second check valve 40, to the high pressure valve, respectively, then flows from the high pressure valve to the inlet of the refrigerant-flow-direction switching device 46 through a high pressure pipe, further enters the gas-liquid separator, and then enters the two-pipe enhanced-vapor-injection indoor unit 44 through the gas pipe from a gas outlet of the gas-liquid separator after passing through the heating solenoid valve. After being condensed into a high-pressure liquid refrigerant in the two-pipe enhanced-vapor-injection indoor unit 44, the refrigerant flows through the electronic expansion valve of the indoor unit, and becomes a high-pressure two-phase refrigerant. The high-pressure two-phase refrigerant flows through the throttling element of the refrigerant-flow-direction switching device 46, returns to the low pressure pipe, passes through the low pressure valve into the outdoor unit, and further enters the inlet of the main path of the supercooler 20 after passing through the seventh check valve 48. After flowing out of the outlet of the main path of the supercooler 20, a part of the refrigerant passes through the throttling assembly 22, becomes a low-pressure two-phase refrigerant, further enters the outdoor heat exchanger 10 to absorb heat, then returns to the low pressure tank via the reversing assembly 18, and further enters the gas return port 164 of the enhanced-vapor-injection compressor 16. Another part of the refrigerant passes through the first throttling device 24, and enters the inlet of the auxiliary path of the supercooler 20. After flowing out of the outlet of the auxiliary path of the supercooler 20, a medium-pressure gaseous refrigerant enters a compression chamber of the enhanced-vapor-injection compressor 16 through the first solenoid valve 26.

Figure 5:
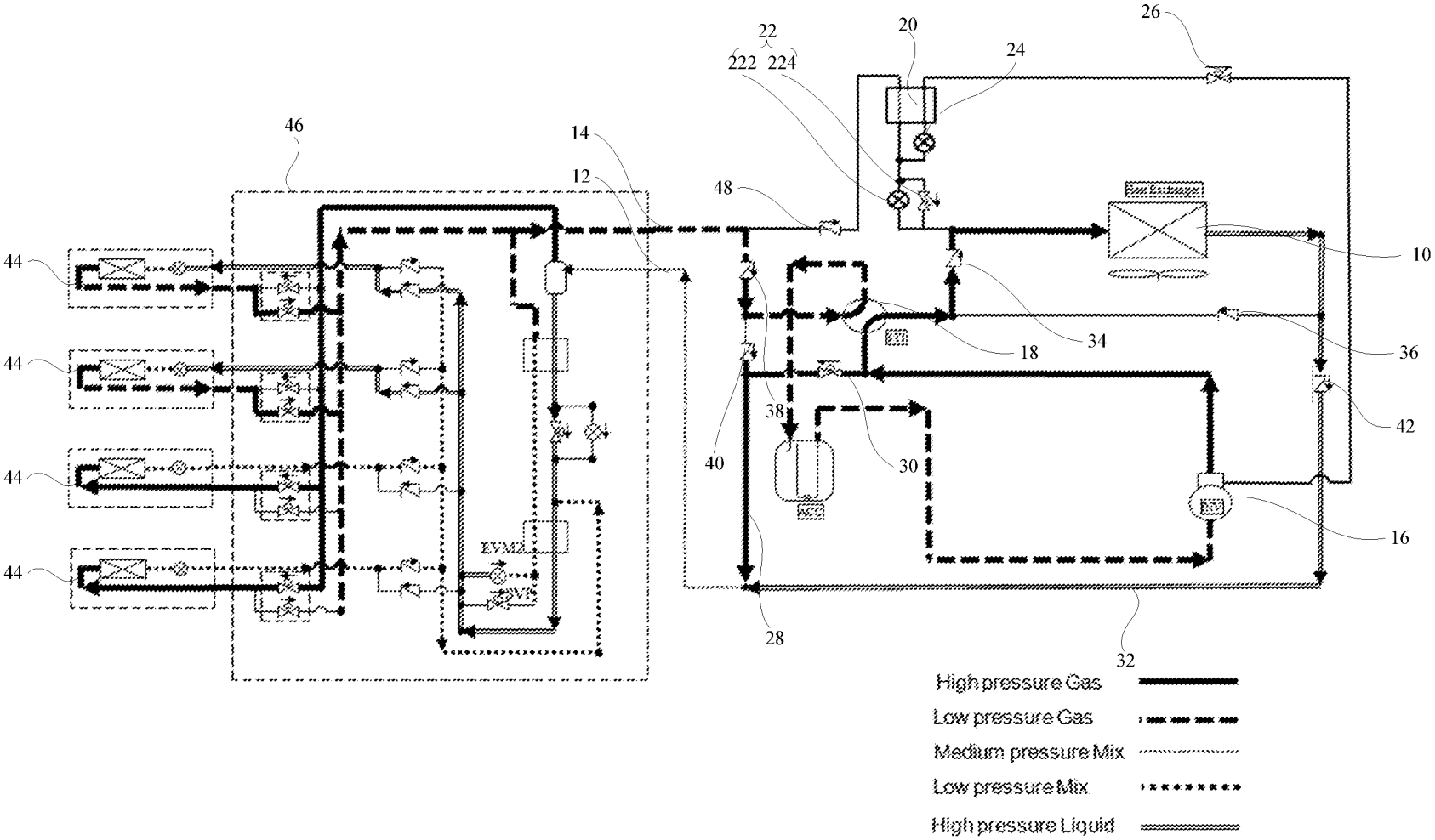
FIG. 5 illustrates a schematic view of a two-pipe enhanced-vapor-injection multi-split system in a main cooling mode provided by an embodiment of the present disclosure.

As shown in FIG. 5, during the main heating, the high-temperature and high-pressure gaseous refrigerant comes out of the enhanced-vapor-injection compressor 16, passes through two paths, i.e. the second solenoid valve 30 as well as the reversing assembly 18 and the second check valve 40, to the high pressure valve, respectively, then flows from the high pressure valve to the inlet of the refrigerant-flow-direction switching device 46 through a high pressure pipe, and further enters the gas-liquid separator. The high-pressure gaseous refrigerant comes out of the gas outlet of the gas-liquid separator, passes through the heating solenoid valve, and enters the heating two-pipe enhanced-vapor-injection indoor unit 44 through a gas pipe. The condensed high-pressure liquid refrigerant passes through the electronic expansion valve of the indoor unit and then flows back to the inlet of the second supercooling device of the refrigerant-flow-direction switching device 46. The refrigerant becomes the high-pressure liquid refrigerant after flowing out of the second supercooling device and enters the cooling two-pipe enhanced-vapor-injection indoor unit 44 via the cooling check valve. The refrigerant becomes the medium-pressure two-phase refrigerant after being throttled by the electronic expansion valve, enters the indoor unit to evaporate and absorb heat, and hence becomes the medium-pressure gaseous refrigerant. The medium-pressure gaseous refrigerant is converged with the medium-pressure two-phase refrigerant flowing through the throttling element of the refrigerant-flow-direction switching device 46 in the low-pressure pipe, and further returns to the outdoor unit together. The refrigerant enters the supercooler 20 of the outdoor unit through the seventh check valve 48. A part of the medium-pressure refrigerant flowing out of the outlet of the main path of the supercooler 20 of the outdoor unit passes through the first throttling device 24 and enters the auxiliary path of the supercooler 20. The medium-pressure gaseous refrigerant coming out of the outlet of the auxiliary path passes through the first solenoid valve 26 and enters the compression chamber of the enhanced-vapor-injection compressor 16. Another part of the medium-pressure refrigerant flowing out of the outlet of the main path of the supercooler 20 of the outdoor unit is throttled and depressurized by the throttling assembly 22 and enters the outdoor heat exchanger 10 to evaporate and exchange heat, further flows through the reversing assembly 18 into a low-pressure tank, and then returns to the gas return port 164 of the enhanced-vapor-injection compressor 16.

Figure 4:
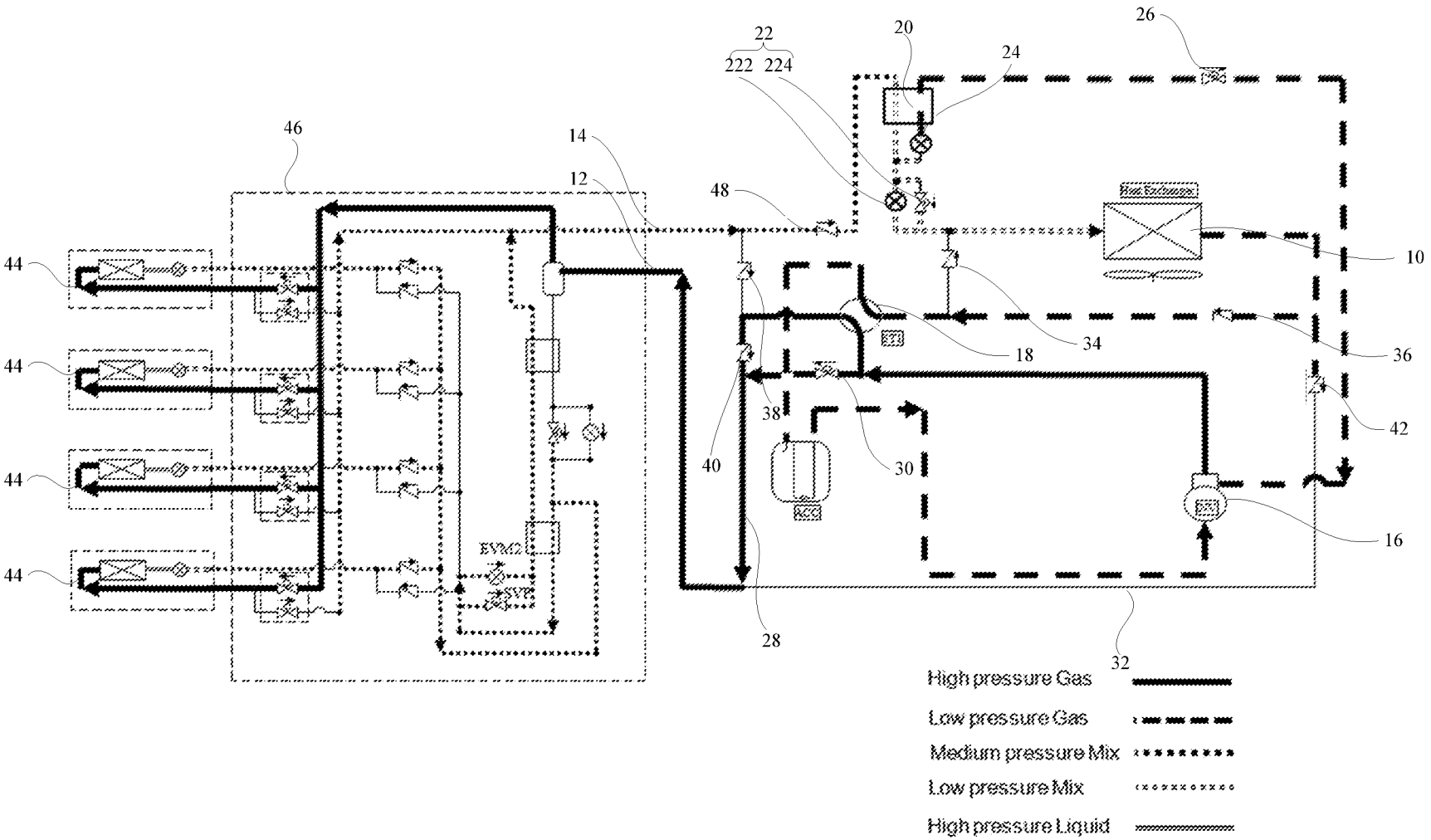
FIG. 4 illustrates a schematic view of a two-pipe enhanced-vapor-injection multi-split system in a heating mode provided by an embodiment of the present disclosure.
Figure 6:
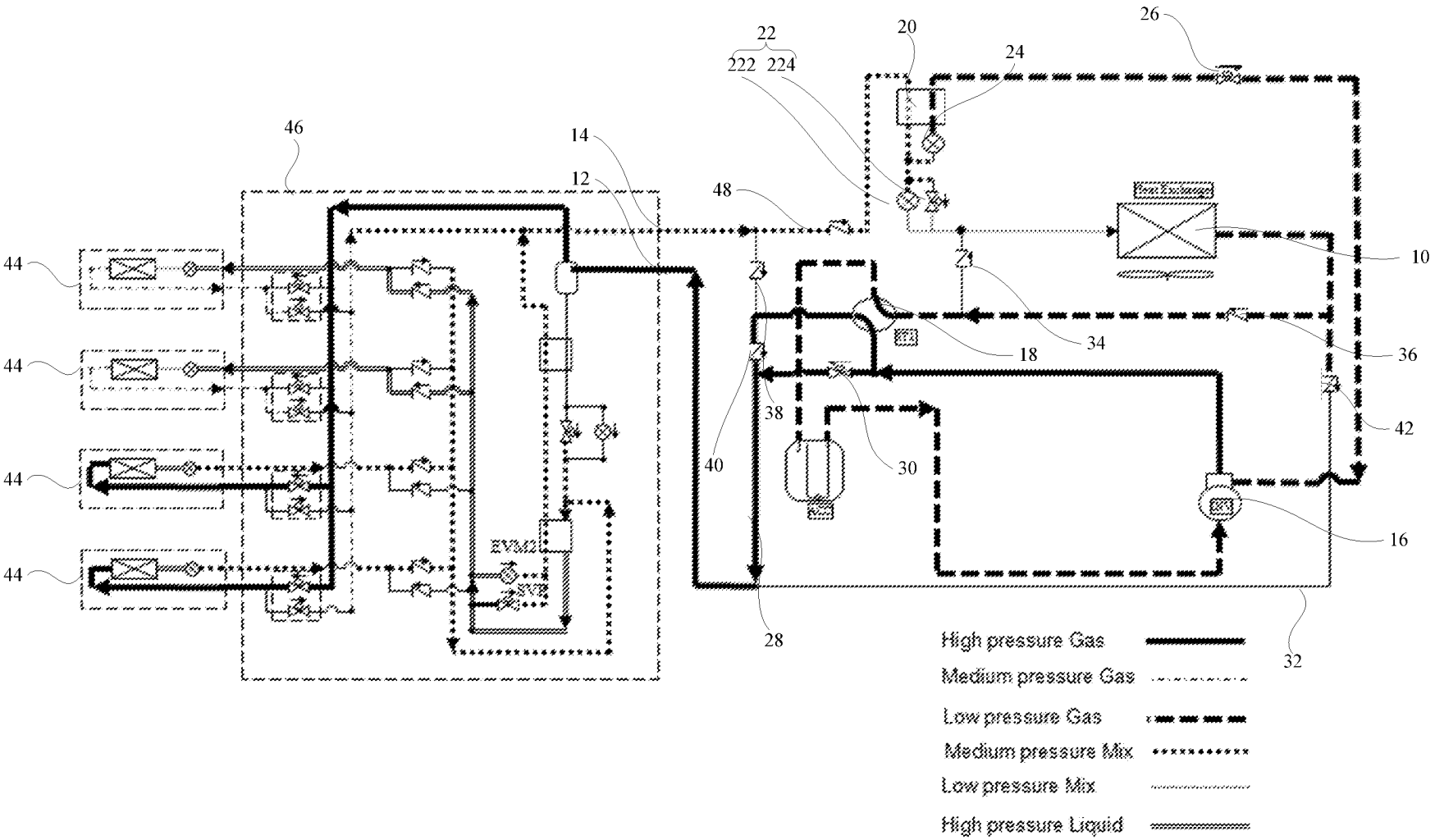
FIG. 6 illustrates a schematic view of a two-pipe enhanced-vapor-injection multi-split system in a main heating mode provided by an embodiment of the present disclosure.

FIG. 4 is a schematic view of the two-pipe enhanced-vapor-injection multi-split system in the cooling mode, in which the flow direction of the refrigerant in the pipeline is shown in the drawing. FIG. 6 is a schematic view of the two-pipe enhanced-vapor-injection multi-split system in the main cooling mode, in which the flow direction of the refrigerant in the pipeline is shown in the drawing.

Figure 7:
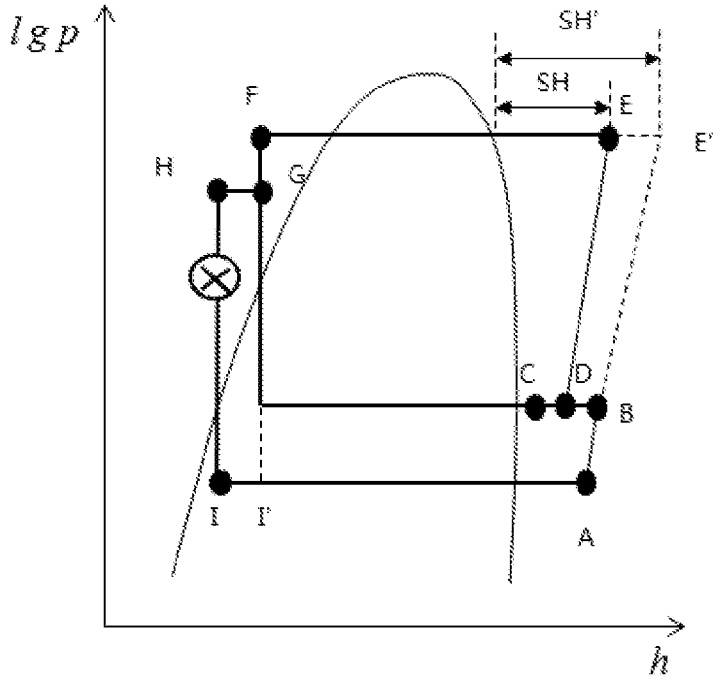
FIG. 7 illustrates a pressure-enthalpy diagram of a two-pipe enhanced-vapor-injection multi-split system provided by an embodiment of the present disclosure.

FIG. 7 shows a pressure-enthalpy diagram which indicates that the two-pipe enhanced-vapor-injection multi-split system provided by the present disclosure can significantly increase the capacity of the heating indoor unit, especially under a low temperature condition. Since a part of the returned gas of the enhanced-vapor-injection compressor has a high pressure, the refrigerant circulation of the system is significantly increased with the same gas displacement at the same frequency. Moreover, the increase of the working of the enhanced-vapor-injection compressor will also improve the capacity.

In the description of the present specification, terms such as "up" and "down" indicate the orientation or position relationship based on the orientation or position relationship illustrated in the drawings only for convenience of description or for simplifying description of the present disclosure, and do not alone indicate or imply that the device or element referred to must have a particular orientation or be constructed and operated in a specific orientation, and hence cannot be construed as a limitation to the present disclosure. The terms "connected," "mounted," "fixed" should be understood broadly. For example, "connected" may indicate fixed connections, detachable connections, or integral connections; may also be direct connections or indirect connections via intervening structures, which can be understood by those skilled in the art according to specific situations.

Reference throughout this specification to terms "one embodiment," "some embodiments," "a specific example," "an example" or "some examples," means that a particular feature, structure, material, or characteristic described in connection with the embodiment or example is included in at least one embodiment or example of the present disclosure. In this specification, exemplary descriptions of aforesaid terms are not necessarily referring to the same embodiment or example. Moreover, the particular features, structures, materials, or characteristics described may be combined in any suitable manner in one or more embodiments or examples.

The above embodiments are only preferred embodiments of the present disclosure, and should not be construed to limit the present disclosure. It can be understood by those skilled in the related art that the present disclosure may have various modifications and changes. Any modifications, equivalents, and improvements made without departing from spirit and principles of the present disclosure should be fallen into the protection scope of the present disclosure.

What is claimed is:

1. A two-pipe enhanced-vapor-injection outdoor unit, comprising:

an outdoor heat exchanger and a second port;

an enhanced-vapor-injection compressor having a gas discharge port, a gas return port and an injection port;

a reversing assembly comprising a first end connected with the gas discharge port, and a second end connected with the gas return port;

a supercooler comprising a main heat-exchange flow path and an auxiliary heat-exchange flow path communicated with each other, the main heat-exchange flow path being connected with the second port, and the auxiliary heat-exchange flow path being connected with the injection port;

a throttling assembly comprising a first end connected with an outlet of the main heat-exchange flow path, and a second end connected with an inlet of the outdoor heat exchanger;

a first check valve connecting the main heat-exchange flow path to the second port, and having a conduction direction from the second port to an inlet of the main heat-exchange flow path;

a second check valve connecting the second port with a fourth end of the reversing assembly, and having a conduction direction from the second port to the fourth end of the reversing assembly;

a third check valve connecting a first port with the fourth end of the reversing assembly, and having a conduction direction from the fourth end of the reversing assembly to the first port;

a fourth check valve connecting a third end of the reversing assembly to the inlet of the outdoor heat exchanger, and having a conduction direction from the third end of the reversing assembly to the outdoor heat exchanger; and a fifth check valve connecting the third end of the reversing assembly to an outlet of the outdoor heat exchanger, and having a conduction direction from the outlet of the outdoor heat exchanger to the third end of the reversing assembly.

2. The two-pipe enhanced-vapor-injection outdoor unit according to claim 1, wherein the two-pipe enhanced-vapor-injection outdoor unit further comprises a first port, a third end of the reversing assembly is switchably connected to the inlet of the outdoor heat exchanger or an outlet of the outdoor heat exchanger, and a fourth end of the reversing assembly is switchably connected to the second port or the first port.

3. The two-pipe enhanced-vapor-injection outdoor unit according to claim 2, wherein the two-pipe enhanced-vapor-injection outdoor unit comprises:

a first solenoid valve arranged between the auxiliary heat-exchange flow path and the injection port, and having a conduction direction from the auxiliary heat-exchange flow path to the injection port.

4. The two-pipe enhanced-vapor-injection outdoor unit according to claim 2, wherein the two-pipe enhanced-vapor-injection outdoor unit comprises:

a first throttling device arranged in the auxiliary heat-exchange flow path, and located at an inlet of the auxiliary heat-exchange flow path.

5. The two-pipe enhanced-vapor-injection outdoor unit according to claim 1, wherein an inlet of the main heat-exchange flow path is connected with the second port, an inlet of the auxiliary heat-exchange flow path is connected with the outlet of the main heat-exchange flow path, and an outlet of the auxiliary heat-exchange flow path is connected with the injection port.

6. The two-pipe enhanced-vapor-injection outdoor unit according to claim 5, wherein the two-pipe enhanced-vapor-injection outdoor unit comprises:

a first solenoid valve arranged between the auxiliary heat-exchange flow path and the injection port, and having a conduction direction from the auxiliary heat-exchange flow path to the injection port.

7. The two-pipe enhanced-vapor-injection outdoor unit according to claim 5, wherein the two-pipe enhanced-vapor-injection outdoor unit comprises:

a first throttling device arranged in the auxiliary heat-exchange flow path, and located at an inlet of the auxiliary heat-exchange flow path.

8. The two-pipe enhanced-vapor-injection outdoor unit according to claim 1, wherein an inlet of the main heat-exchange flow path and an inlet of the auxiliary heat-exchange flow path are both connected with the second port, and an outlet of the auxiliary heat-exchange flow path is connected with the injection port.

9. The two-pipe enhanced-vapor-injection outdoor unit according to claim 8, wherein the two-pipe enhanced-vapor-injection outdoor unit comprises:

a first solenoid valve arranged between the auxiliary heat-exchange flow path and the injection port, and having a conduction direction from the auxiliary heat-exchange flow path to the injection port.

10. The two-pipe enhanced-vapor-injection outdoor unit according to claim 8, wherein the two-pipe enhanced-vapor-injection outdoor unit comprises:

a first throttling device arranged in the auxiliary heat-exchange flow path, and located at an inlet of the auxiliary heat-exchange flow path.

11. The two-pipe enhanced-vapor-injection outdoor unit according to claim 1, wherein the two-pipe enhanced-vapor-injection outdoor unit comprises:

a first solenoid valve arranged between the auxiliary heat-exchange flow path and the injection port, and having a conduction direction from the auxiliary heat-exchange flow path to the injection port.

12. The two-pipe enhanced-vapor-injection outdoor unit according to claim 11, wherein the two-pipe enhanced-vapor-injection outdoor unit comprises:

a second pipe connecting the gas discharge port to a first port; and a second solenoid valve arranged in the second pipe, and having a conduction direction from the gas discharge port to the first port.

13. The two-pipe enhanced-vapor-injection outdoor unit according to claim 11, wherein the two-pipe enhanced-vapor-injection outdoor unit comprises:

a first throttling device arranged in the auxiliary heat-exchange flow path, and located at an inlet of the auxiliary heat-exchange flow path.

14. The two-pipe enhanced-vapor-injection outdoor unit according to claim 1, wherein the two-pipe enhanced-vapor-injection outdoor unit comprises:

a first throttling device arranged in the auxiliary heat-exchange flow path, and located at an inlet of the auxiliary heat-exchange flow path.

15. The two-pipe enhanced-vapor-injection outdoor unit according to claim 1, wherein the throttling assembly comprises at least one second throttling device and at least one sixth check valve connected in series, and the sixth check valve has a conduction direction from the supercooler to the inlet of the outdoor heat exchanger.

16. The two-pipe enhanced-vapor-injection outdoor unit according to claim 15, wherein the two-pipe enhanced-vapor-injection outdoor unit comprises:

a third pipe having a first end connected with an outlet of the outdoor heat exchanger, and a second end arranged between the third check valve and the first port; and a seventh check valve arranged in the third pipe.

17. A two-pipe enhanced-vapor-injection multi-split system, comprising a two-pipe enhanced-vapor-injection outdoor unit according to claim 1.

* * * * *